US006851516B2

(12) United States Patent
Petzl et al.

(10) Patent No.: US 6,851,516 B2
(45) Date of Patent: Feb. 8, 2005

(54) ATTACHMENT DEVICE WITH ENERGY ABSORBER AND SAFETY LANYARDS

(75) Inventors: Paul Petzl, Barraux (FR); Jean-Marc Hede, Domene (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 10/365,392

(22) Filed: Feb. 13, 2003

(65) Prior Publication Data

US 2003/0155177 A1 Aug. 21, 2003

(30) Foreign Application Priority Data

Feb. 20, 2002 (FR) ..... 02 02162

(51) Int. Cl.[7] ..... A47L 3/04
(52) U.S. Cl. ..... 182/3
(58) Field of Search ..... 182/3, 4, 6, 5, 182/7, 9, 36, 45, 112, 113; 244/151 R

(56) References Cited

U.S. PATENT DOCUMENTS 3,322,102 A * 5/1967 Windle ..... 182/3
4,100,996 A * 7/1978 Sharp ..... 182/3
5,090,503 A 2/1992 Bell
5,174,410 A 12/1992 Casebolt
5,287,943 A 2/1994 Bell
6,374,945 B1 * 4/2002 Sherwood ..... 182/3
6,390,234 B1 * 5/2002 Boyer ..... 182/3

FOREIGN PATENT DOCUMENTS

| | | |
|---|---|---|
| FR | 2 677 258 | 12/1992 |
| FR | 2 732 226 | 10/1996 |
| WO | WO 01/26738 A1 | 4/2001 |

* cited by examiner

*Primary Examiner*—Hugh B. Thompson, II
(74) *Attorney, Agent, or Firm*—Oliff & Berridge, PLC

(57) ABSTRACT

An attachment device having a pair of main progression lanyards, an auxiliary lanyard, and an energy absorber to absorb shocks in case of a fall. The auxiliary lanyard is attached with the main lanyards to the energy absorber opposite from a fixing device, and is shorter than each of the main lanyards so as to act as additional attachment means placed after the energy absorber.

5 Claims, 2 Drawing Sheets

ATTACHMENT DEVICE WITH ENERGY ABSORBER AND SAFETY LANYARDS

BACKGROUND OF THE INVENTION

The invention relates to a safety attachment device for progression of a user along a handrail, and comprising:

a pair of main progression lanyards each equipped with a means for attaching a snap-hook, an energy absorber to absorb shocks in case of a fall, an auxiliary lanyard, and a fixing means designed to be joined to the user's harness.

Such devices are used for the safety of people performing pot-holing or climbing in particular on a via ferrata.

STATE OF THE ART

It is conventional to make use of safety lanyards for self-belaying of a person progressing on a ledge or a path along a handrail. They generally comprise an energy absorber associated with a pair of main lanyards each equipped with a snap-hook. The energy absorber can be formed by a stretch webbing as described in the document FR 2,677,258, or by a shock absorber with progressive blocking of the lanyards of the type mentioned in the document FR 2,732,226.

The main lanyards must have a certain length to attach the snap-hooks in complete safety to each cable connection of the handrail. The length of the lanyards must also be sufficient depending on the height of the handrail with respect to the ledge. This length is generally comprised between 80 cm and 120 cm.

If the user rests when traversing suspending himself on one of the main lanyards hooked onto the handrail or to a fixed bar of the via ferrata, it will be difficult for him to reach the handrail or the bar to unhook the snap-hook. The same case arises when resting on an overhang.

To overcome these drawbacks, users often have recourse to a third short lanyard which is connected directly to the roping harness. This short lanyard acts solely as a resting lanyard, on account of the fact that it does not benefit from the damping effect of the energy absorber. The same is the case for the auxiliary lanyard of the attachment device of the document FR 2,759,916, which is fixed in a circular hole of a metal plate without any possibility of damping.

OBJECT OF THE INVENTION

The object of the invention is to achieve a safety attachment device for a handrail, able to be used for progression or resting of a person regardless of the user's size and of the position of the handrail.

The device according to the invention is characterized in that the auxiliary lanyard is attached with the main lanyards to the energy absorber opposite from the fixing means, said auxiliary lanyard being shorter than each of the main lanyards so as to act as additional attachment means placed after the energy absorber.

This auxiliary lanyard can therefore be used as a rest lanyard, but also as a progression lanyard benefiting from the damping safety of the absorber in case of a fall.

According to a preferred embodiment, the energy absorber is joined to the main lanyards and to the auxiliary lanyard by a joining part, for example formed by a metal ring. The energy absorber is formed by a stretch webbing joined to the main lanyards and the fixing means.

The energy absorber can also be formed by a damper with progressive blocking of the lanyards.

According to another feature of the invention, the short lanyard is stitched onto at least one of the main lanyards after the absorber.

BRIEF DESCRIPTION OF THE DRAWINGS

Other advantages and features will become more clearly apparent from the following description of an embodiment of the invention given as a non-restrictive example only and represented in the accompanying drawings in which.

DESCRIPTION OF A PREFERRED EMBODIMENT

Figure 1:
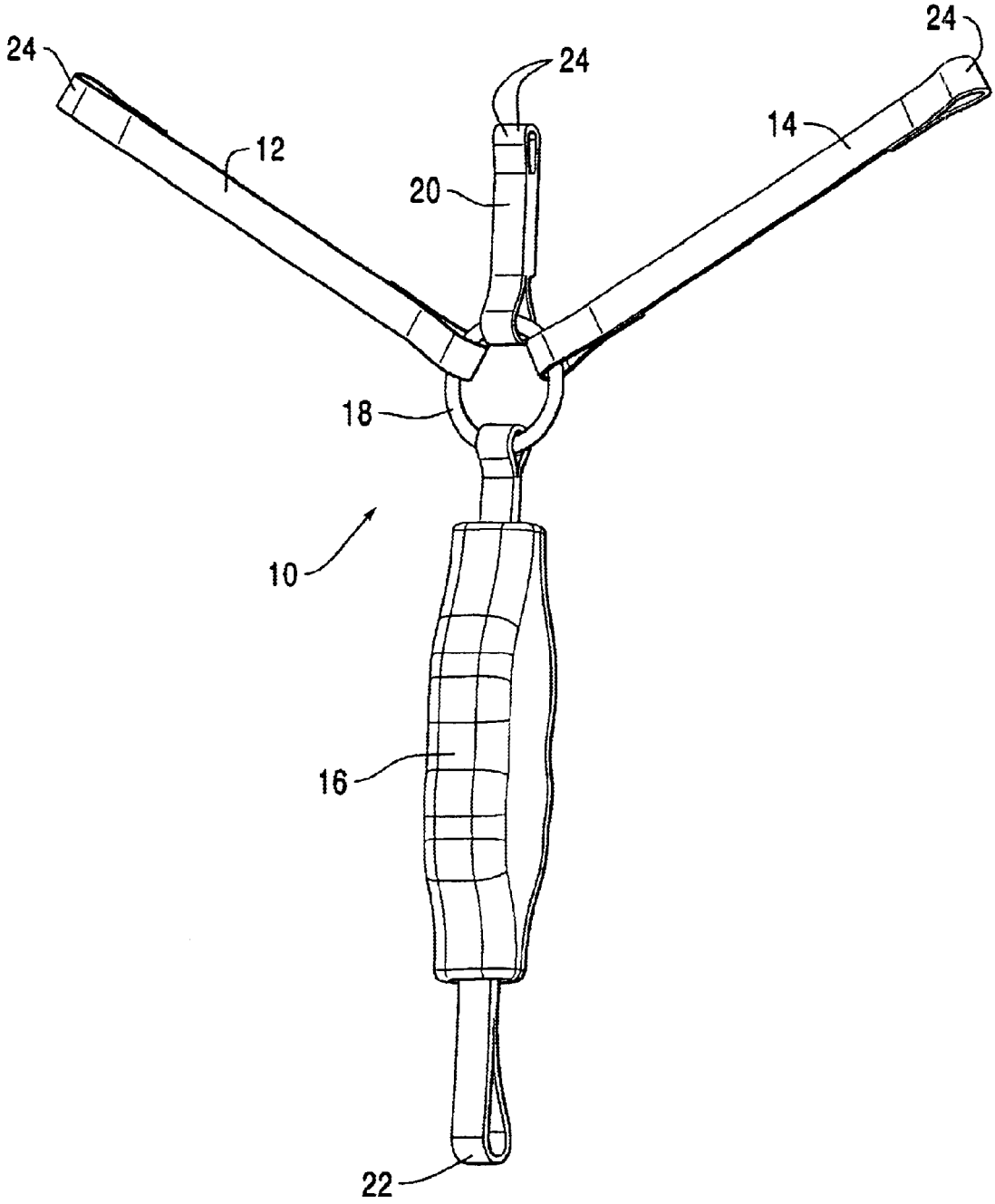
FIG. 1 is a schematic elevation of the attachment device according to the invention.

In FIG. 1, an attachment device 10 is composed of a pair of main progression lanyards 12, 14 designed to ensure the safety of a person moving along a handrail, for example a rope, or a cable installed on a via ferrata run.

The two main lanyards 12, 14 are joined to an energy absorber 16 by means of a metal ring 18, whereto an auxiliary lanyard 20 is also attached. The two main lanyards 12, 14 are of appreciably the same length, whereas the auxiliary lanyard 20 is shorter.

Opposite the ring 18, the energy absorber 16 is joined to a fixing means 22 designed to be joined to the user's harness or baldrick. The fixing means 22 is formed for example by a loop wherein a snap-hook is fixed.

The energy absorber 16 is formed for example by a stretch webbing and the fixing means 22 always remains attached to the ring 18 by the stretched webbing.

Each free end of the two main lanyards 12, 14 and of the short auxiliary lanyard 20 is equipped with an attachment means 24 able to receive a snap-hook or any other safety device. The lanyards 12, 14, 20 are formed in FIG. 1 by webbings, but it is clear that they can be replaced by rope elements.

Either one of the two main lanyards 12, 14 is used during normal progression along the handrail. The auxiliary lanyard 20 is also placed downline from the absorber 16 and acts:

either as rest lanyard by attaching to a bar or a bail of the via ferrata;

or as a short progression lanyard if the position of the handrail and the user's size allow;

or as lanyard for attaching a pulley for Tyrolean traversing.

The presence of the absorber 16 between the fixing means 22 of the attachment device 10 and the ring 18 gives the user optimum safety regardless of which of the three lanyards 12, 14, 20 is used.

Figure 4:
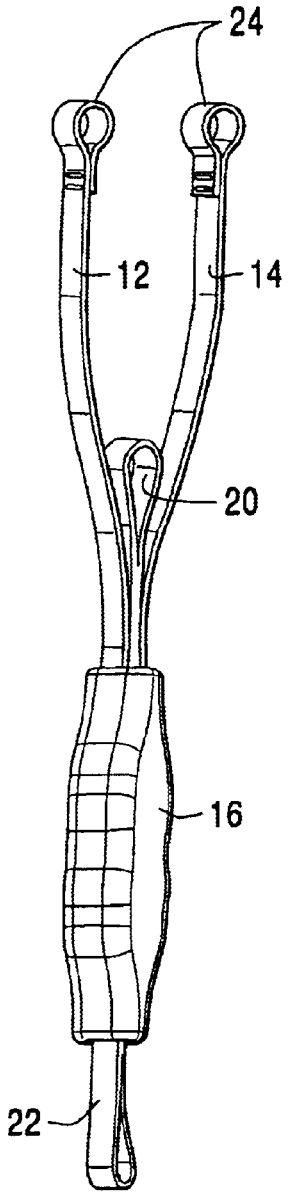
FIGS. 2 to 4 represent different alternative embodiments of the device of FIG. 1.
Figure 3:
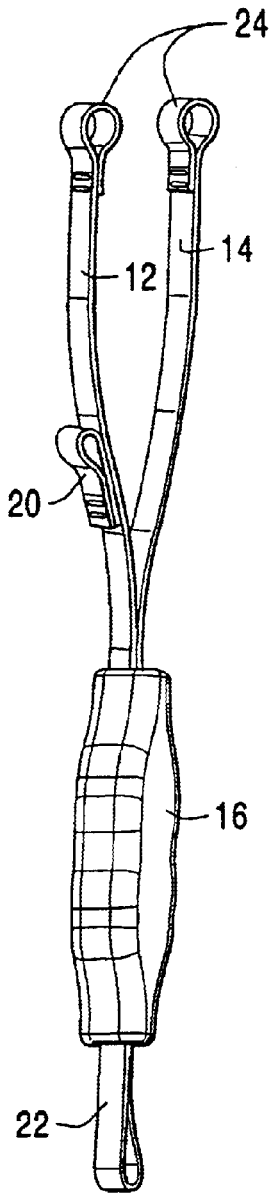
Figure 2:
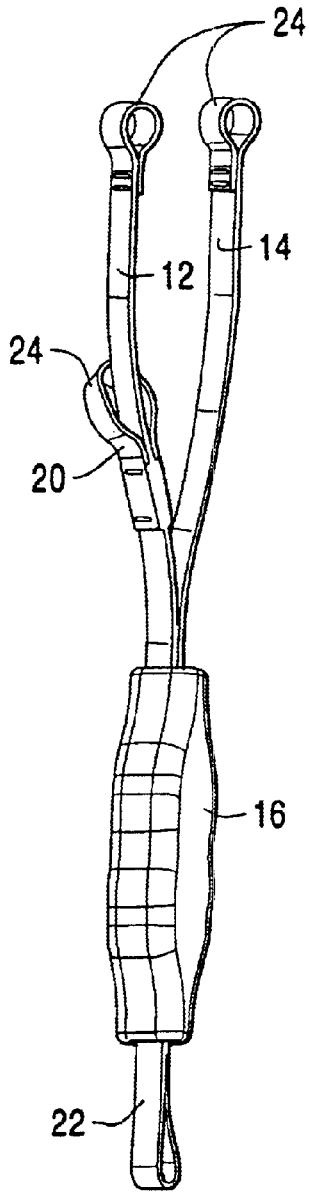

FIGS. 2–4 represent alternative embodiments where the metal ring 18 for attaching the lanyards 12, 14, 20 of FIG. 1 has been eliminated. The main lanyards 12, 14 are joined to the stretch webbing of the absorber 18 by seams.

In FIG. 2, the auxiliary lanyard 20 is formed by a webbing loop stitched onto the opposite faces of the main lanyard 12 at a location close to the absorber 16.

In FIG. 3, the webbing loop is stitched onto one side on the main lanyard 12.

In FIG. 4, the webbing loop of the auxiliary lanyard 20 is stitched onto the internal faces of the two main lanyards 12, 14 directly on leaving the absorber 16.

It is clear that the auxiliary lanyard 20 can be replaced by any other attachment part shorter than each of the two main lanyards 12, 14.

What is claimed is:

1. A safety attachment device, comprising:

a pair of main progression lanyards, for progression of a user along a handrail, each equipped with a means for attaching a snap-hook;

an energy absorber to absorb shocks in case of a fall;

an auxiliary lanyard;

and fixing means attached to the energy absorber for joining the device to the user's harness, wherein the auxiliary lanyard is attached with the main lanyards to the energy absorber opposite from the fixing means, said auxiliary lanyard being shorter than each of the main lanyards so as to act as additional attachment means placed at a side of the absorber opposite the fixing means.

2. The safety attachment device according to claim 1, wherein the energy absorber is joined to the main lanyards and to the auxiliary lanyard by a joining part.

3. The safety attachment device according to claim 2, wherein the joining part is formed by a metal ring.

4. The safety attachment device according to claim 1, wherein the auxiliary lanyard is stitched onto at least one of the main lanyards.

5. The safety attachment device according to claim 1, wherein the energy absorber is formed by a stretch webbing joined to the main lanyards and the fixing means.

* * * * *